US005287641A

United States Patent [19]

Showers

[11] Patent Number: 5,287,641

[45] Date of Patent: Feb. 22, 1994

[54] COLLECTIBLE CARD DEVICE

[75] Inventor: Jon J. Showers, Glenolden, Pa.

[73] Assignee: Neet Ideas Incorporated, Broomall, Pa.

[21] Appl. No.: 755,107

[22] Filed: Sep. 5, 1991

[51] Int. Cl.[5] ..... G09F 1/12; G09F 7/00

[52] U.S. Cl. ..... 40/488; 40/124.1

[58] Field of Search ..... 40/445, 486, 488, 124.1; 434/368, 405

[56] References Cited

U.S. PATENT DOCUMENTS

| | | | |
|---|---|---|---|
| 1,898,308 | 2/1933 | Miller | 40/445 |
| 2,028,650 | 1/1936 | Cunningham | 40/445 |
| 2,319,519 | 5/1943 | Rosaire | 434/405 |
| 2,611,201 | 9/1952 | Bellis | 434/368 X |
| 2,963,806 | 12/1960 | King | 40/445 |
| 4,031,850 | 6/1977 | Gantt | 434/405 X |
| 4,697,364 | 10/1987 | Dean | 40/445 |

*Primary Examiner*—Peter R. Brown

*Assistant Examiner*—J. Bonifanti

*Attorney, Agent, or Firm*—Eugene E. Renz, Jr.

[57] ABSTRACT

A card device, comprising an elongated blank folded to form a front panel and a back panel and including a fastener means to form a card with one unsealed end. The front panel has a die cut opening of a predetermined size and shape with a clear window panel covering the opening and displaying a first image thereon. An image enhancing slidable insert sized to be inserted between the front and back panels through the unsealed end is provided and includes an outwardly facing surface contrasting with the first image to enhance the first image. A second image is placed on the inwardly facing surface of the back panel, including a visible image portion and a background portion which is aligned to substantial reduce the visibility of the first image. Accordingly, insertion of the slidable insert enhances the first image and removal of the slidable insert causes exposure of the second image to the substantial exclusion of the first image.

2 Claims, 2 Drawing Sheets

COLLECTIBLE CARD DEVICE

FIELD OF THE INVENTION

The present invention relates to a trading card device which is useful in collectible series such as cards for baseball and other sports, advertising promotional items, magazine covers, movie posters and the like. More particularly, the present invention relates to collectible card devices which may be personalized instantly by the insertion of a photograph or which may contain multiple images which are alternatively displayed.

BACKGROUND OF THE INVENTION

Baseball cards are among the most widely collected memorabilia. Collectors seek both old cards, which are traded and which have been increasing in market value, and new cards to complete collections for each team for each season. Baseball cards have photographs of the player, as well as importance statistics and other information. Individual manufacturers of baseball cards also include trade dress and other identifying indicia, so that collectors can easily determine the source of the series from which any card originated.

In addition to baseball cards, other sports have similar cards, although collection and value have not reached the economic or numerical proportions of baseball cards. Other cards exist in areas of interest other than sports have not yet reached a significant market size. Nevertheless, growth in these areas will depend upon the degree of inherent interest in the topic and also on the amount of marketing effort expended.

In addition to straightforward collecting of baseball cards and the like, persons young and old enjoy time spent with the cards, perhaps in using their imagination to select all time favorite teams or best statistics for individuals or teams, and engaging in imaginary trading and managing decisions an the like.

One such baseball card market in which ones imagination and even ones fantasies can be enjoyed is the children's market, in which an ordinary child who might be playing in age group baseball can fantasize about playing on a major league team. This fantasy or "playing", which many experts believe is desirable for intellectual growth, would be enhanced if a child's image could also be provided on a baseball card. However, it is almost essential that the fantasy card, if that is a reasonable name for the card containing the child's photograph, be accurate and substantially identical with established and recognized, or "real" baseball cards.

Prior art methods of meeting this need have not been well received, however. The only product which has been available to date is one in which a person mails a photograph to a marketing company. The particular or logo identifying indicia of a particular brand of baseball card is than burned in or printed on top of the photograph. No matter what photograph is used, the likeness to a real baseball card is marginal at best and is hardly worth the effort one must expend in order to obtain this marginal card. One clear disadvantage is the time delay of up to eight to ten weeks from order to satisfaction. Ten weeks is too large a portion of a major league season to wait.

Accordingly, while it is not presently possible, the fantasy or dream would be complete if the personalized baseball card with perhaps an actual photograph of the collector would look like a real baseball card and would be available substantially immediately. Accordingly, it is an object of the present invention to provide such a card.

One device which has been proposed for use with photographs is shown in U.S. Pat. No. 4,662,093 to Suttles et al. This device includes a front and back panel with a die cut opening. A photograph is held by an initial attaching means which aligns the photograph. The panels are thereafter folded and fastened permanently. There is no attempt to present a plurality of images which cooperatively permit a combination of publically known images with personalized photos and the like.

At the present time, baseball cards and the like are limited to one photograph or image. Larger book-like designs no longer resemble a baseball card and thus do not truly belong in a collection. Nevertheless, card devices which include a combination of two messages or images have great potential and it is another object of the present invention to provide such a device.

Yet another area in which virtually no commercial success has been realized is in personalized promotional, advertising and packaging material. For example, personalized magazine covers are at best a novelty item in which a photograph is mailed, and the replica is returned in perhaps six to ten weeks and after substantial expense. Personalized movie posters do not exist at all and character representations of various personalities are not available except perhaps on a custom order basis. Accordingly, yet another object of this invention is to provide a card device which can be inexpensively and immediately used in personalizing promotional, advertising, character merchandising, and packaging materials.

SUMMARY OF THE INVENTION

It has now been discovered that the above and other objects of the present invention may be accomplished in the following manner. Specifically, it has been discovered that an improved card device can be provided which allows for inexpensive and immediate personalization of a card which is virtual identical to a device, product or concept which is already on the market, such as presently available baseball cards and the like.

The card device of the present invention comprises an elongated blank, usually made from cardboard, which has been folded to form a front panel and a back panel. The blank includes fastening means such as glue to form a card with one unsealed or opened end. A die cut opening is made in the front panel and has a predetermined size and shape. While the opening may be rectangular or square or round, other shapes including those which have a cut out of a recognizable shape are also contemplated.

At least the front panel has printing on it which it conveys a predetermined visual pattern. Typically, a baseball card from one manufacturer has certain features which are common for every year and other features which distinguish that year's series from other years. The pattern may also be in the form of a poster, cereal box, magazine or whatever the imagination is lead to create. Clearly, the back panel may also have a predetermined visual pattern, which may include statistics, advertising, spaces for the purchaser to add hand written information, and the like.

The device also includes a slidable insert which is sized to be inserted between the front and back panels through the unsealed end. The insert forms a photo template for defining the size of a photo which is to be inserted between the front and back panels through that unsealed end after the slidable insert has been removed. The photo is cut to the size of the template of the slidable insert. The folded end and two sealed ends formed by the fastening means align the template sized photo for cooperative interaction with the predetermined visual picture on the front panel.

In a preferred embodiment, the invention also includes a clear window panel covering the die cut opening and having a first image thereon. An image enhancing slidable insert is provided to be inserted between the front and back panels through the unsealed end. This insert has an outwardly facing surface forming a contrast with the first image on the clear window panel to enhance the first image. A second image is formed on the inward facing surface of the back panel such that the second image includes a visible image portion and a background portion which is aligned to substantially reduce or eliminate the visibility of the first image on the clear window panel. Thus, when the insert is in the device, the first image is visible. Removal of the slidable insert causes exposure of the second image to the substantial exclusion of the first image.

BRIEF DESCRIPTION OF THE DRAWINGS

The objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
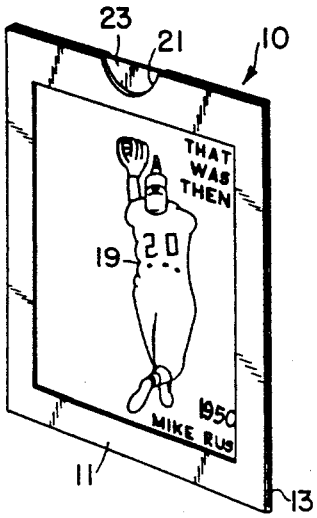
FIG. 1 is a perspective view of a device illustrating a preferred embodiment of the present invention, shown in a first condition.
Figure 4:
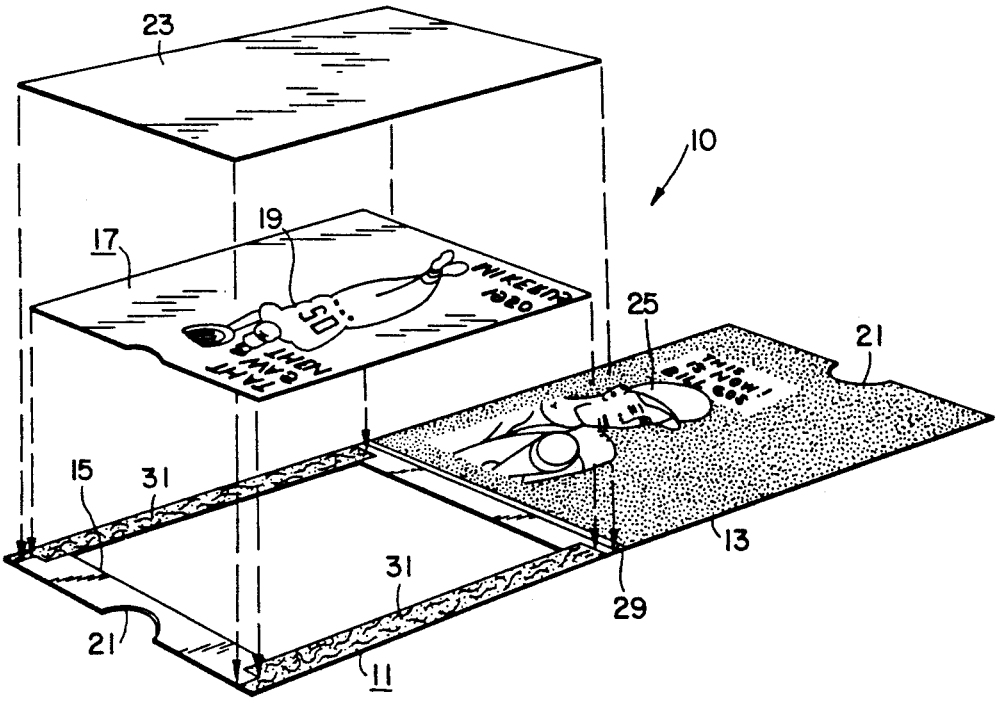
FIG. 4 is an exploded perspective view of the device of FIG. 1, showing details of construction.

The present invention comprises a card device shown generally at 10 in FIG. 1. The device concludes a front panel 11 and back panel 13, formed as shown in FIG. 4 and described herein below. The device further includes an open area or die cut opening 15. Die cut 15 is covered by a clear window panel 17 covering the opening 15 and having a first image 19 thereon.

The front panel 11 and back panel 13 include a cut out portion 21 which allows the user to insert and remove an image enhancing slidable insert 23. Slidable insert 23 is inserted between front panel 11 and back panel 13. The outwardly facing surface of the insert 23 usually contrasts with the first image 19 to enhance the image. For example, when image 19 is drawn in a dark color, such as blue or black, the outward face of insert 23 would be white or another light color to maximize contrast and enhance the image 19.

Figure 2:
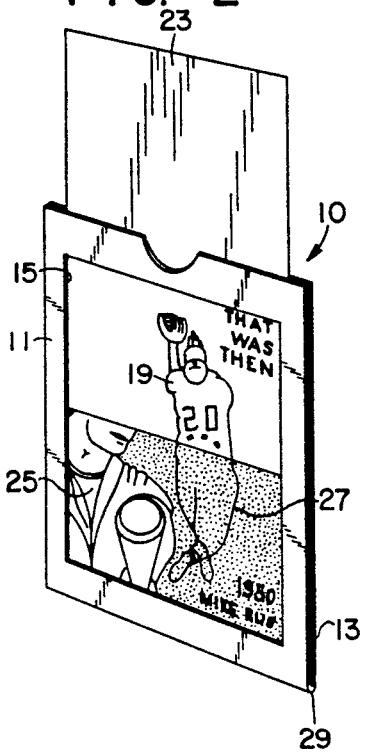
FIGS. 2 and 3 are additional perspective views of the device shown in FIG. 1 shown in partial and full conversion to a second condition.
Figure 3:
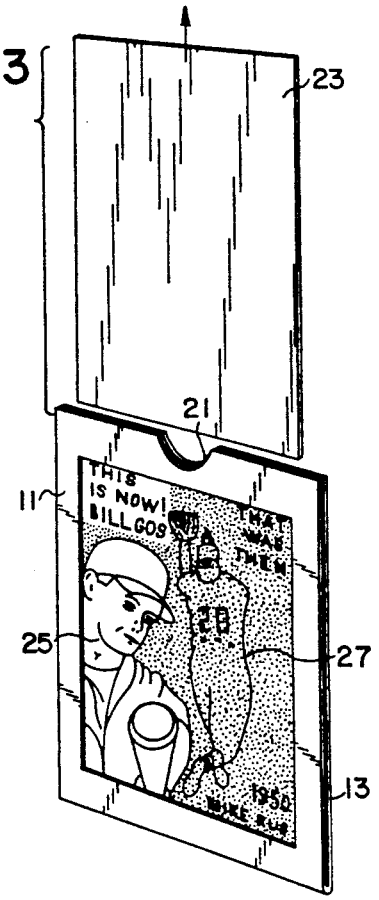

Printed on the inside facing surface of the back panel 13, is a second image 25 which has a visible portion, such as the person shown in FIG. 2 and 3 and a background portion which is aligned to substantially reduce the visibility of first image 19. For example, if image 19 is formed from black ink, the background portion of the second image 25 will also be black, so that the clear window panel 17 presents only a faded image 27 which may or may not be visible to casual inspection.

In one form, the preferred embodiment shown in FIGS. 1 through 3 allows for a comparison over a period of time. While any indicia may be printed on the clear window panel 17 and the inward facing surface of the back panel 13, it is intended that images 19 and 25 cooperatively convey information to the user. For example, as shown in FIGS. 1, 2 and 3, image 19 includes a reference to the past in the phrase "that was then." Image 25 includes a reference to the present, using the phrase "this is now."

In use, the card device normally presents a view of the first indicia 19 indicating a past event which perhaps brings positive memories. For example, a famous but no longer active athlete from a particular team may be pictured. Alternatively, the first image 19 may be a non personalized baby picture, wedding picture, a picture representing the first day of school, and the like. Removal of the image enhancing slidable insert 23 causes image 19 to fade into the background contained on the inside facing surface of back panel 13. The second image 25 includes a visible image portion shown by the picture of the person and a background portion, where the background portion is aligned to substantially reduce the visibility of the faded image 27.

Again, for example and illustration purposes only, the present picture may be a famous or successful athlete from the same team as the retired player. Alternatively, in cooperation with the past memory suggested previously, the second image 25 may represent a second milestone such as a baby picture of a grandchild or child of the first represented person, or an anniversary photograph, a graduation photograph, or the like. Clearly, the only limitation is the degree of ingenuity in the imagination of the manufacturer.

Turning now to FIG. 4 and the construction of the embodiment described in the first three figures, it is noted that the front panel 11 and back panel 13 are formed from an elongated blank which is folded along fold or score line 29 to form a card device of the typed described. Adhesive 31 is provided to fasten the clear window panel 17 in the appropriate location. Back panel 13 is folded over front panel 11 along fold 29 to form the completed object shown in FIGS. 1 through 3, leaving one open end. Cutouts 21 provide finger access to the card 23 which may be inserted and removed through the unsealed end as illustrated in FIGS. 1 through 3.

In an alternative embodiment, the back panel 13 may have a complete background portion as its second image on the inwardly facing surface of panel 13. The background is aligned to substantially reduce the visibility of the first image 19 as shown in FIGS. 1 through 3. The slidable image enhancing insert 23 contains template dimensions which allow a photograph to be cut to an appropriate size. The cooperative arrangement of the fold 29 and the adhesive edges 31 align the photograph to present a second image while the remaining background on the inside surface of back panel 13 substantially reduces the visibility of the first image as previously described.

Figure 5:
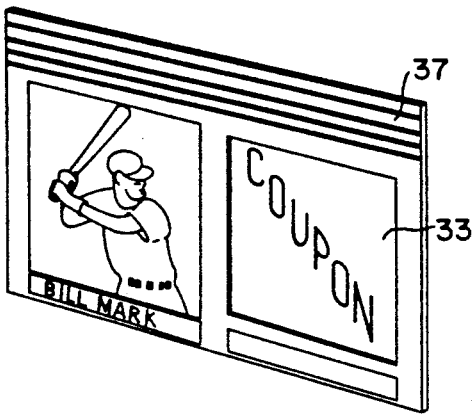
FIGS. 5, 6, 7 perspective views of a device illustrating a second embodiment of the present invention.
Figure 6:
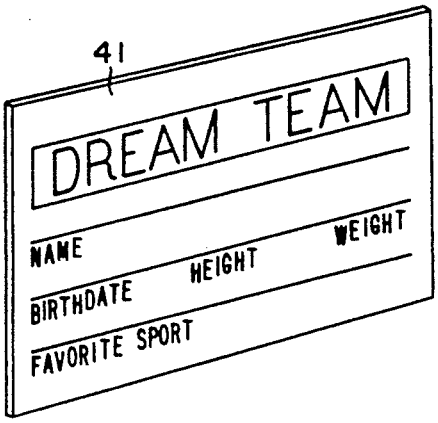
Figure 7:
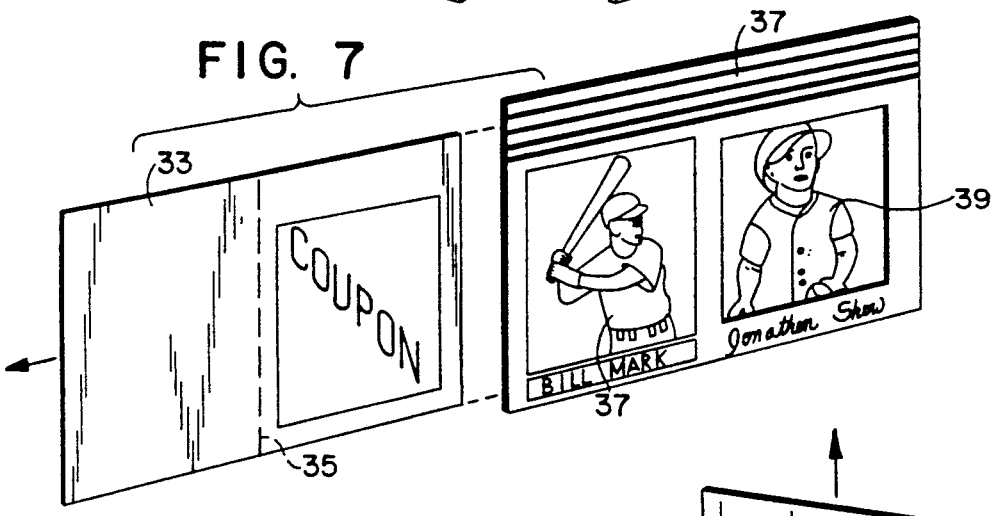

FIGS. 5, 6 and 7 show an alternative embodiment in which a device similar to that described is presented, with the absence of a clear window panel. In this embodiment a front panel 11 and back panel 13 are folded along fold 29 and die cut opening 15 is also provided. Insert 33 is inserted between the front and back panels 11 and 13 through the unsealed end. Insert 33 is a photo template for defining the size of a photo for insertion between front panel 11 and back panel 13. The photo, when it is cut to the dimensions shown on the template 33, will be centered by cooperative action between the fastening means, such as adhesive 31, and the folded score line 29 for cooperative interaction with material which might be placed on the card. For example, photo area 35 of slidable insert 33 defines a photo template. The photo is inserted into the card between the front panel 11 and the back panel 13 for cooperative action with the predetermined pattern 37 which has been printed on the front panel 11. Photo 39 presents a photograph which is in cooperative interaction with the photograph of the athlete which is part of the predetermined visual pattern 37 on the face of front panel 11.

It is noted that the slidable insert 33 may have a wide variety of uses. For example, the slidable panel 33 may comprise a coupon or have sweepstake numbers or may include a "scratch and win" printing. Instructions for use of the card device may also contained on the slidable insert 33. There is also space on the slidable insert 33 for other information, such as product advertising and notices of missing children. Again, only the imagination will limit the amount and type of information which may be printed on slidable insert 33.

Figure 8:
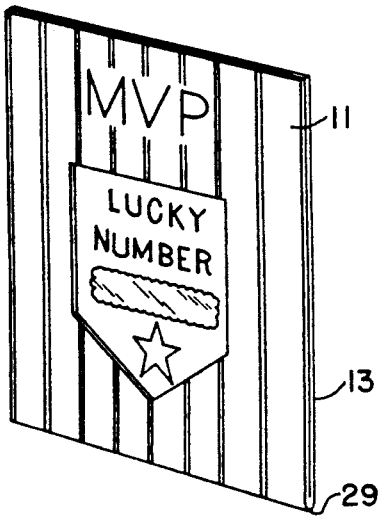
FIG. 8 and 9 are perspective views of a device illustrating a third embodiment of the present invention.
Figure 9:
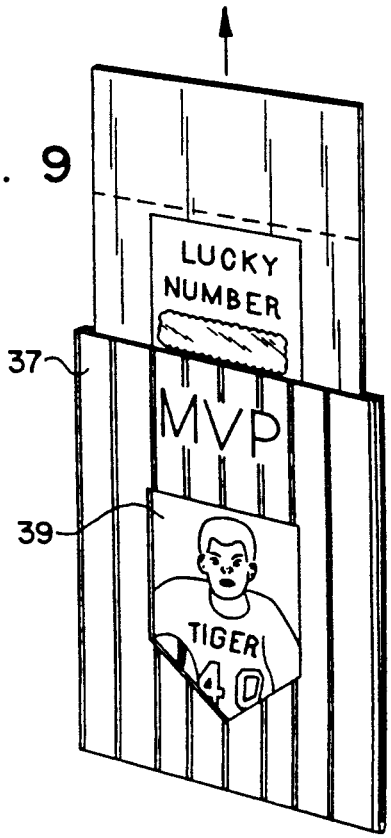

Shown in FIGS. 8 and 9 is a third embodiment of the present invention which takes the form of commercially well known trading cards. Of course, these cards would be printed by the owner of the rights to the specific topic cards, or under a license granting that right. Instead of a baseball player for a particular team, a slidable insert 33 would be provided which serves as a template for sizing a photograph 39 to be inserted between front panel 11 and rear panel 13 and to be centered to cooperate with the fastening means, including in this case fold 29 and glue 31 to align the photo 39 for cooperative interaction with the predetermined visual picture 37. The alignment may be very precise or relatively casual.

Both the second and third embodiments may include printing 41 on the back of panel 13 for any desired message. In baseball replicas, where a child's photograph is to be inserted, a fanciful batting average and other statistics can be printed, or space can be provided for insertion of the child's actual performance in a children's baseball league.

Again, a coupon such as coupon 33 can be provided along with the card device as described herein.

As can be seen, the card device of the present invention provides a system for the first time in which photographs and image can be combined in an economical and efficient manner to provide a virtually endless number of informative and appealing products. While particular embodiments of the present invention, such as baseball cards and the like, have been illustrated and described herein, it is not intended to limit the invention to any form of printing or other visual images. Changes and modifications may be made herein within the scope of the following claims.

What is claimed is:

1. A personalized card device, comprising:

a photo having a predetermined size;

an elongated blank folded on a single fold to form a front and a back panel, and including fastening means to form a card with one unsealed end;

a customized die cut opening in said front panel having a predetermined size and shape, said front panel having printing thereon to convey a predetermined visual pattern in cooperation with said die cut opening;

an insert sized to be inserted between the front and back panels through said unsealed end to be completely recessed within said card, said insert forming a photo template for defining the size of said photo to control insertion of said photo between said front and back panels through said unsealed end and centered to cooperate with said fastening means to prevent movement of said photo and to align said photo for cooperative interaction with said predetermined visual pattern to thereby provide a personalized card device having a visual cooperation between said photo and said card, whereby said photo replaces said insert photo template.

2. The device of claim 18, wherein said die cut opening and said predetermined visual pattern are aligned to present side by side images when a photo is defined by said template and inserted between said front and back panel, said photo and said predetermined visual pattern each forming one of said side by side images.

* * * * *